US006482480B1

(12) United States Patent
Lordahl et al.

(10) Patent No.: US 6,482,480 B1
(45) Date of Patent: Nov. 19, 2002

(54) ORNAMENTAL ACCESSORY AND METHOD OF MAKING SAME

(76) Inventors: Var Lordahl, 1571 Schaeffer Rd., Long Grove, IL (US) 60047; Stanley Hasbrouck, 240 Poppy La., Bensenville, IL (US) 60106

( * ) Notice: Subject to any disclaimer, the term of this patent is extended or adjusted under 35 U.S.C. 154(b) by 0 days.

(21) Appl. No.: 09/591,811

(22) Filed: Jun. 12, 2000

(51) Int. Cl.[7] ..... A47G 33/04

(52) U.S. Cl. ..... 428/11; 7/542.2; 362/252; 362/806; D13/134

(58) Field of Search ..... 428/7, 11, 19, 428/542; D13/134; 362/252, 806

(56) References Cited

U.S. PATENT DOCUMENTS 1,855,772 A * 4/1932 Raymond
2,486,636 A * 11/1949 Egle
2,803,904 A * 8/1957 Burnbaum

* cited by examiner

*Primary Examiner*—Deborah Jones
*Assistant Examiner*—Abraham Bahta
(74) *Attorney, Agent, or Firm*—Kajane McManus

(57) ABSTRACT

The ornamental accessory comprises a planar structure having a uniquely feathered periphery. The particular accessory illustrated is in the form of a star which frictionally engages about a bulb of a string of lights. The injection molding method for producing the accessory comprises the steps of: producing a two piece die for the desired base configuration for the accessory; clamping the die closed through application of clamping pressure against the pieces of the die; and injecting a suitable substance into the die at a pressure greater than the clamping pressure to allow the injected substance to bleed outwardly between the pieces of the die.

4 Claims, 2 Drawing Sheets

FIG. 1
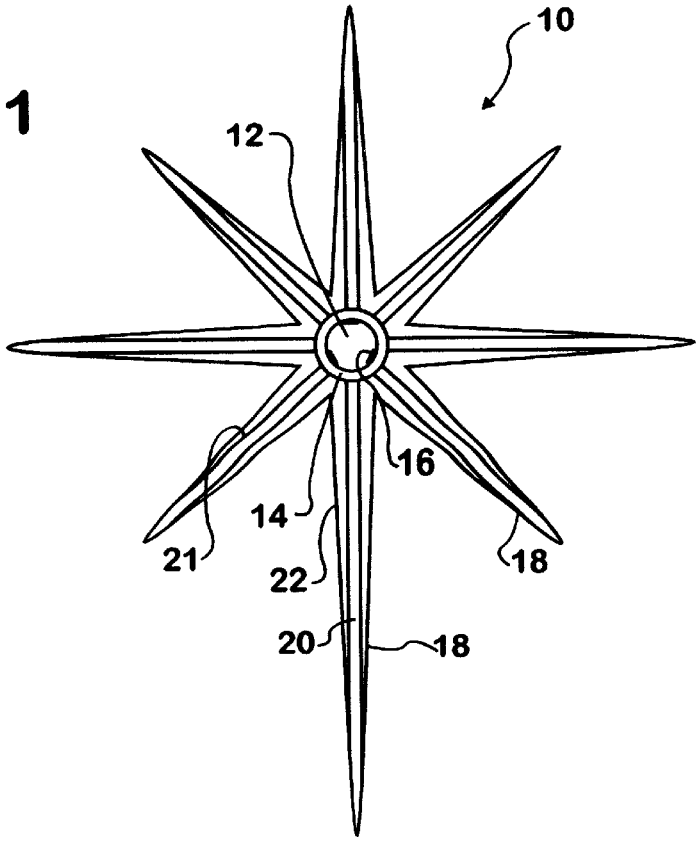
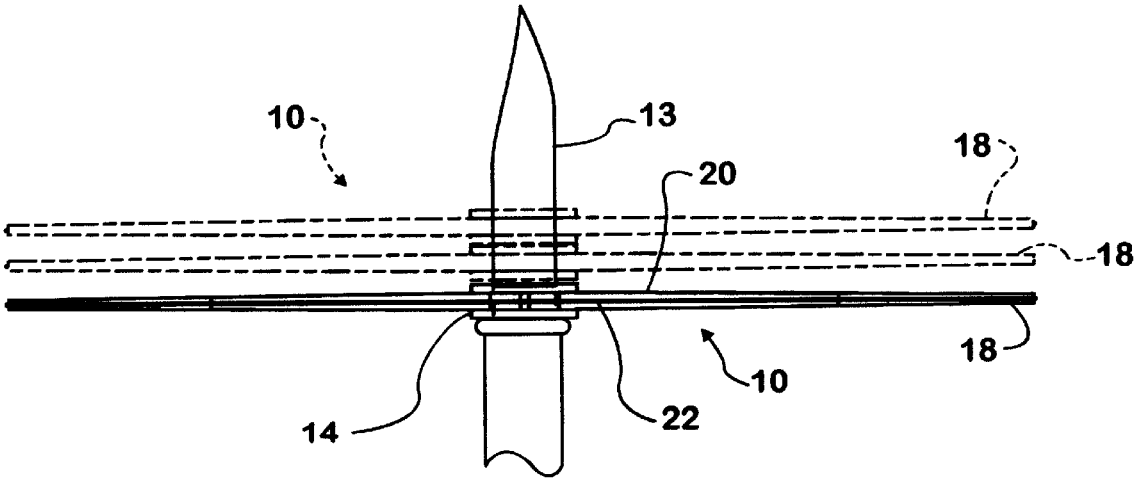
FIG. 2

ORNAMENTAL ACCESSORY AND METHOD OF MAKING SAME

BACKGROUND OF THE INVENTION

1. Field of the Invention

The present invention relates to an ornamental accessory and method of making same. More particularly the accessory is injection molded in an unorthodox manner to provide a feathered edge thereto, with the method providing the feathered edge configuration.

2. Prior Art

Heretofore, ornamental accessories have been proposed for use in combination with lights such as those used to decorate a tree at Christmas, for example. Such accessories are usually in the form of a reflective backing for the bulbs of the lights, or have taken the configuration of an item into which the bulb is inserted to light same.

However, to date, there has not been proposed an ornamental accessory as described hereinafter or the method of making same.

SUMMARY OF THE INVENTION

According to the invention there is provided an ornamental accessory incorporating a center throughbore defined within the accessory and a plurality of radial arms protruding outwardly from and around said throughbore.

Further according to the invention there is provided a method for creating by injection molding an accessory having a feathered configuration along an outer periphery thereof comprising the steps of producing a two piece die for the desired base configuration of the accessory; clamping the die closed through application of pressure against the pieces of the die; and, injecting a suitable substance into the die at a pressure greater than the clamping pressure to allow the injected substance to bleed outwardly between the pieces of the die.

Still further according to the invention there is provided an ornamental accessory made by the above method.

BRIEF DESCRIPTION OF THE DRAWINGS

FIG. 1 is a perspective view of an ornamental accessory made by conventional injection molding.

FIG. 2 is a side view of a bulb showing at least one ornamental accessory engaged thereto.

DESCRIPTION OF THE PREFERRED EMBODIMENT

Figure 3:
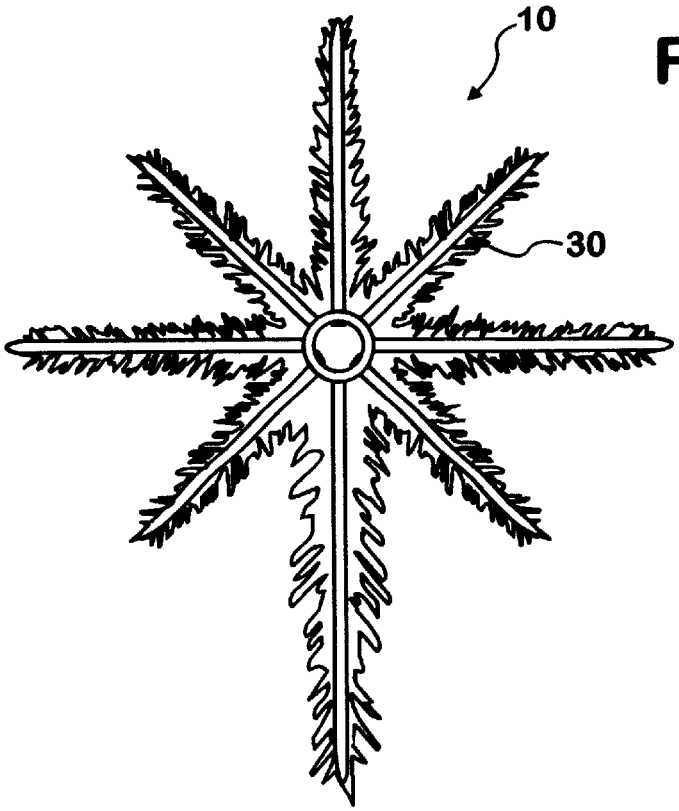
FIG. 3 is a perspective view of an ornamental accessory made by the method of the present invention.

Referring now to the drawings in greater detail, there is illustrated in FIG. 1 an ornamental accessory 10 having a simple base configuration of a planar star 10, which is created using known injection molding techniques.

As shown, the star 10 incorporates a center throughbore 12 defined within a collar 14 having nubs 16 thereon which extend radially into the throughbore 12. In the particular embodiment disclosed, the throughbore 12 is sized to be frictionally engaged over the circumference of a miniature light bulb 13 of a string of decorative lights (not shown) although this should not be construed as limiting.

Extending radially outwardly of the collar 14 is a plurality of arms 18. Each arm 18 includes a center rib 20 from each side 21 of which a thin flange 22 extends, each flange widening across its extent as it becomes more proximal to the collar 14.

As is known in the art of injection molding, each line and surface is ear, crisp, and precise.

FIG. 2 is a side view of the accessory 10 showing same to be a substantially planar element, with the collar 14 being the widest portion of the accessory 10. In a preferred embodiment of the invention, as illustrated in phantom, more than one accessory 10 can be engaged to a single miniature bulb 13 by stacking if desired. From this Figure, it will also be confirmed that the flanges 22 are far thinner than the center rib 20 of each arm 18.

Figure 4:
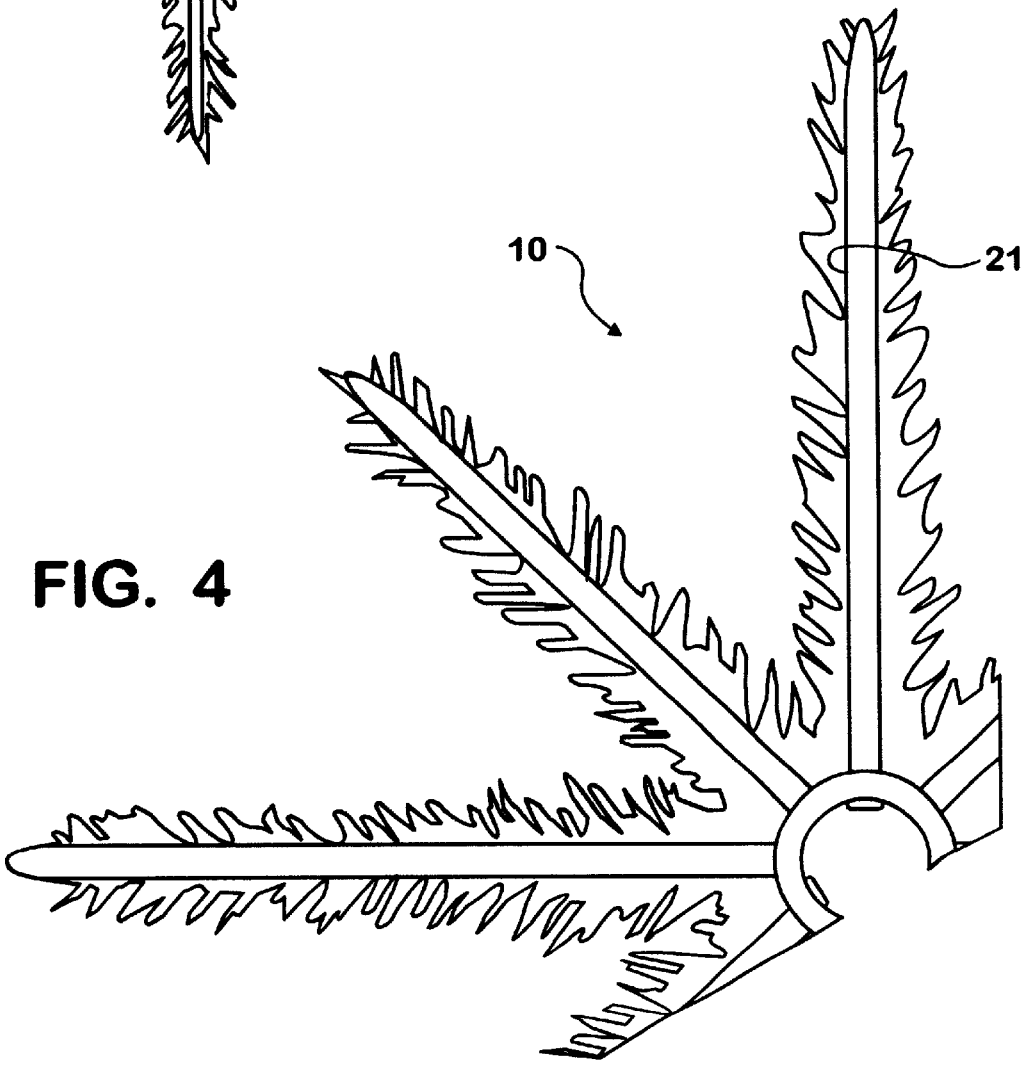
FIG. 4 is an enlarged detailed perspective view of a portion of the accessory of FIG. 3.

Turning now to FIGS. 3 and 4, there is illustrated therein an ornamental accessory 10 also having a base shape of a star 10, identical to that of FIG. 1.

However, using the method to be defined hereinafter, the crisp, clean lines of each flange 22 have been eradicated and replaced by a feathered edge 30.

Although the star 10 of FIG. 1 is very aesthetically pleasing when lit up by the bulb 13 over which it is engaged, the star 10 of FIGS. 3 and 4 is far more ornate and breathtaking when lit by the bulb 13 over which it is engaged, creating an exceedingly spectacular vision, most particularly when a plurality of such stars 10 are engaged onto a single bulb 13 and set askew from one another.

Light from the bulb 13 appears to shoot down the rib 20 of each arm 18, diffusing laterally outwardly therefrom across the flanges 22, creating an enlarged area of light about the bulb 13.

It is proposed in a preferred embodiment for the accessory 10 to create same from a clear transparent plastic, though this should not be construed as limiting.

Also, although a simplistic form of a star 10 is used as exemplary, this should not be construed as limiting. Further, it will be understood that the illustrated embodiments of the accessory 10 can be mingled, as desired.

Turning now to the method of creating the accessory 10 of FIGS. 3 and 4, it has been stated hereinabove they are created by injection molding.

Typically, when an item is to be created by injection molding, a two piece die is used, with the pieces of the die being held together by the application of pressure thereagainst. Crisp, clean lines are obtained in the molding process when the pressure of injection into the die of suitable material is maintained below the clamping pressure used to hold the pieces of the die together, or closed.

However, it has been observed that, upon increasing injection pressure and/or decreasing the clamping pressure holding the die closed to a level where the injection pressure is greater, the precision of the die casting can be overcome, providing the feathered edge 30 to the accessory 10 of FIGS. 3 and 4.

It has never previously been proposed to overcome die precision in this manner. Nor has creation of a feathered edge 30 been proposed using the above modified method of injection molding.

It will be understood that there is no way to control bleeding of the material between pieces of the die when the method described is used. Accordingly, each star 10 created by the method has a unique pattern of the feathers edge 30 of the flanges 22.

As described above, the accessory and method of the present invention provide a number of advantages, some of which have been described above and others of which are inherent in the invention. Also, modifications may be proposed to the above disclosure without departing from the teachings therein. Accordingly, the scope of the invention is only to be limited as necessitated by the accompanying claims.

We claim:

1. An ornamental accessory incorporating a center throughbore defined with the accessory, the throughbore being sized and configured to frictionally engage the accessory onto a bulb of a string of lights, and the accessory comprising a plurality of planar radial arms protruding outwardly from and around said throughbore wherein each arm includes a center rib and a feathered flange extends laterally outwardly to either side of said rib.

2. The accessory of claim 1 wherein the throughbore has nubs protruding inwardly thereinto.

3. The accessory of claim 1 being planar and of a thickness to allow more than one accessory to be engaged onto the bulb.

4. A method for creating the ornamental accessory of claim 1 comprising the steps of:

producing a two piece die for the desired base configuration of the accessory;

clamping the die closed through application of clamping pressure against the pieces of the die; and, injecting a suitable substance into the die at a pressure greater than the clamping pressure to allow the injected substance to bleed outwardly between the pieces of the die.

* * * * *